US010378864B2

(12) United States Patent
Soukos

(10) Patent No.: US 10,378,864 B2
(45) Date of Patent: Aug. 13, 2019

(54) ECOLOGICAL SHOOTING TRAINING PANEL FOR ANY TYPE AND CALIBER AMMUNITION

(71) Applicant: Konstantinos Soukos, Larisa (GR)

(72) Inventor: Konstantinos Soukos, Larisa (GR)

( * ) Notice: Subject to any disclaimer, the term of this patent is extended or adjusted under 35 U.S.C. 154(b) by 108 days.

(21) Appl. No.: 15/073,248

(22) Filed: Mar. 17, 2016

(65) Prior Publication Data

US 2017/0248393 A1 Aug. 31, 2017

(51) Int. Cl.

| | |
|---|---|
| ***F41J 1/01*** | (2006.01) |
| ***F41J 1/10*** | (2006.01) |
| ***F41J 9/14*** | (2006.01) |
| ***F41J 13/02*** | (2009.01) |

(52) U.S. Cl.
CPC . *F41J 1/10* (2013.01); *F41J 1/01* (2013.01); *F41J 9/14* (2013.01); *F41J 13/02* (2013.01)

(58) Field of Classification Search
CPC ..... F41J 1/10; F41J 1/00; F41J 13/00; F41J 13/02
See application file for complete search history.

(56) References Cited

U.S. PATENT DOCUMENTS 4,317,572 A * 3/1982 Iseli ..... F41J 13/00 273/404
4,445,693 A * 5/1984 Angwin ..... F41J 13/00 273/404
4,458,901 A * 7/1984 Wojcinski ..... F41J 13/00 273/410
4,819,946 A * 4/1989 Kahler ..... F41J 13/00 273/404
5,405,673 A * 4/1995 Seibert ..... F41H 5/02 273/317
5,907,930 A * 6/1999 Ricco, Sr. ..... F41J 11/02 273/404
8,313,103 B2 * 11/2012 O'Neal ..... F41J 13/02 273/404
8,479,464 B2 * 7/2013 Holzworth ..... F41J 1/01 273/403
8,714,554 B2 * 5/2014 Chu ..... F41J 3/00 273/403

(Continued)

*Primary Examiner* — Melba Bumgarner
*Assistant Examiner* — Amir A Klayman
(74) *Attorney, Agent, or Firm* — Adams & Wilks

(57) ABSTRACT

An ecological shooting training panel has a compact metal sheet retained by a first metal support frame, a rhomboid-shaped metal mesh disposed on the compact metal sheet, and a compact layer of elastomeric material covering the rhomboid-shaped metal mesh. The rhomboid-shaped metal mesh is retained by a second metal support frame connected to the first metal support frame. The elastomeric material is spaced from the compact metal sheet to provide an open gap formed by the compact metal sheet, rhomboid-shaped metal mesh and elastomeric material. A target is configured to be removably mounted over the elastomeric material such that when a projectile is fired at the target, the projectile passes through the target and the combined structural arrangement of the compact metal sheet, rhomboid-shaped metal mesh and elastomeric material absorbs an impact energy of the projectile, and residue generated by the projectile drops through the open gap.

20 Claims, 12 Drawing Sheets

(56) References Cited

U.S. PATENT DOCUMENTS

| | | | | |
|---|---|---|---|---|
| 8,910,944 | B2 * | 12/2014 | Mason, III | F41J 1/10 273/403 |
| 9,057,588 | B1 * | 6/2015 | Simpson | F41J 1/10 |
| 9,255,773 | B1 * | 2/2016 | Hall | F41J 1/10 |
| 9,494,391 | B1 * | 11/2016 | Broadbent | F41J 1/01 |
| 9,534,873 | B2 * | 1/2017 | Urban | F41J 1/10 |
| 10,203,181 | B1 * | 2/2019 | Choi | F41G 3/2694 |
| 2011/0233870 | A1 * | 9/2011 | Oh | F41J 13/00 273/410 |
| 2012/0126480 | A1 * | 5/2012 | Bassett | F41J 11/02 273/410 |
| 2013/0087974 | A1 * | 4/2013 | Chu | F41J 3/00 273/348 |
| 2013/0187336 | A1 * | 7/2013 | Dreiband | F41J 13/02 273/410 |
| 2013/0249168 | A1 * | 9/2013 | Kepple | F41H 5/04 273/408 |
| 2013/0328269 | A1 * | 12/2013 | Tsipouras | F41J 13/00 273/410 |
| 2014/0239595 | A1 * | 8/2014 | Morgan | F41J 1/10 273/403 |

* cited by examiner

ECOLOGICAL SHOOTING TRAINING PANEL FOR ANY TYPE AND CALIBER AMMUNITION

BACKGROUND

Field

The invention relates to an ecological shooting training panel, which has been invented in order to be used as a trap type targeting framework in places where shooting practice takes place, as surface coating material in shooting areas—such as walls, ceilings, floors—but also as a material used to create shooting areas for civil use. The present invention has been invented to achieve the safe absorption and decomposition of ammunition of any type and caliber and retain the decomposition residues in the interior, thus achieving in an ecological way, the avoidance of environmental pollution by lead particles.

BACKGROUND INFORMATION

The existing educational shooting panels and the varying modulation trap systems are widely used in the police training academies and Special Forces, in closed and open shooting ranges, in private shooting clubs, etc. They are usually made from high-volume steel, they constitute a heavy and bulky construction, they cover a large installation area and they are designed to protect against a specific type of ammunition.

In a shooting range where the absorption of the energy of the projectiles is required, the projectiles impact on or in traps and are probably cut in many directions. The ricochet risk of the projectile is even greater in cases where targeting occurs at very short distances, particularly under a large angle. Fragments from rebound, which return to the shooter, must be rare in a properly modulated shooting range.

The projectiles that do not collide on the education targets and in the trap can penetrate floors or ceilings, creating serious risks for the surrounding area in ranges not properly maintained or where effective cleaning is difficult. It has been observed that the traps in a panel or well shape and any kind of protective layers for floors, walls, ceilings increase the likelihood for ricochet when their cleaning is required (accumulation of several projectiles and their fragments).

Regular disassembly operations, removal of the accumulated projectile residues and reassembly are included within the rules of a shooting range, which are characterized as time-consuming and limiting the time that a shooting range, a shooting area, etc. will be used. These procedures, besides being relatively complex, require a considerable cost and they are very tiring.

Also, the usual practice in ranges or shooting ranges until today, simply intends to the concentration of projectiles by applying a fixed barrier directly behind the targets. The concentration is achieved by creating a natural embankment or installing a metal vertical barrier in order to fragment the bullet and reduce the kinetic energy of the fragments. This method presents the following environmental disadvantages:

1. The metals which make up the bullet (usually copper and lead) end up on the ground and their accumulation causes environmental pollution.

2. In the case of bullet fragmentation, lead powder is also formed which pollutes the air. In the case of shooting ranges with close-distances or closed ranges, the amounts of lead powder exceed the allowed safety limits for the human body and can enter the respiratory system of the shooter, causing health problems.

Shooting traps and shooting panels of all types and compositions are nowadays a popular trend and are used as a training targeting framework. But they form permanent structures, of high-volume and, high costs, with no possibility of replacing individual parts, with doubtful results as far as the absorption and the retention of projectiles is concerned. US1989/4819946 A and US1984/4458901A describe types of shooting traps of non-stable and non-durable construction, providing dubious protection, unlike the present invention.

SUMMARY

The invention concerns to an ecological shooting training panel for any type and caliber ammunition that achieves projectiles safe absorption and decomposition as well as the decomposition residues retention in the interior, so as to be achieved in an ecological way the prevention of environmental pollution by lead particles.

The ecological shooting training panel for any type and caliber ammunition mainly comprises a metal compact sheet which bears a metal support frame in which is placed a metallic support frame of rectangular cross section from high hardness steel which bears a layer of numerous high hardness metal plates in a specific arrangement to each other to create a repeated metal mesh with rhomboid shape, in which a selected hybrid elastomer, a spreadable material of one component, based on polyurethane and synthetic acrylic resins, has been injected. Optionally, the training panel may bear an imprinted goals rotation system.

Among the major features of the invention is that the ecological shooting training panel of suitable dimensions is designed to achieve the absorption and decomposition of the incoming projectiles and the retention of their residues, as well as the extraction of the residues from the inner part of the mentioned invention, thus achieving in an ecological way the avoidance of environmental pollution by lead particles.

According to the present invention, the above mentioned objectives, and many more that will be better understood hereinafter, are achieved in an ecological shooting training panel for any type and caliber ammunition, thanks to the way and order of layers arrangement from which it consists of and thanks to the selection of the materials used so as to achieve secure retention and flow of the projectile fragments by gravity and effectively prevent all of the adverse effects of lead particles emission.

The present invention relates to an ecological shooting training panel for any type and caliber ammunition, comprising:

i. A compact metal sheet (2) of rectangular cross section from high hardness steel, including:
   a. metal support frame (3) of rectangular cross section and high hardness which is fixedly screwed around the compact metal sheet (2), apart from the bottom side; and
   b. Suitable suspension points (9);

ii A metallic support frame (4) of rectangular cross section from high hardness steel having a layer of numerous metal plates of high hardness in a specific arrangement to each other to create a repeated metal mesh with rhomboid shape (5);

iii. A hybrid elastomer (6), a spreadable material of one component, based on polyurethane and synthetic acrylic resins;

iv. A fragments outlet and concentration hopper (7) of high hardness metal;

v. Optional support bases (1) and various forms of transport and handling equipment (33); and vi. Optional an imprinted goals rotation system (8).

Specifically, the present invention aims at presenting the construction of an ecological shooting training panel for any type and caliber ammunition, in which the following are obtained:

a) retaining all the properties-benefits of a shooting training panel for ammunition of any type and caliber, since the absorption, the decomposition of the incoming projectiles and the retention of their residues are achieved, as well as the exit of the residues from the interior of the invention, and b) avoiding the environmental pollution from the lead particles.

An ecological shooting training panel for any type and caliber ammunition has many advantages according to the present invention.

Since the present invention relates to a shooting surface which in its simplest form is flat, its construction is simple in relation to the surprising results it achieves. The way of the construction with the small thickness it features in total makes the present invention easy to use because its volume allows the invention's installation and operation in any desired area. Also, it may be manufactured in different sizes, shapes and thicknesses.

Having brought about the best possible arrangements of layers of different materials in a specific order, it also offers the greatest possible protection of the user from ricochet and inhalation of hazardous decomposition materials (harmful dust retention). Thus all the desired features are achieved-absorption, decomposition of the projectiles of all types and caliber, retaining of decomposition residues, preventing ricochet and avoiding fragments from the interior of the invention, as well as its self-cleaning and the safe use without adverse effects on health and the environment.

The use of numerous metal plates and their placement so as to produce a periodic metal mesh with rhomboid shape, create a gap between the metal layer and the elastic layers, to allow the accumulation of the decomposition residues of the projectiles and their flow through the gravity to the lower part of the composite surface. Not having placed a metal outline at the bottom part of the metal compact sheet the removal of fragments from within the layers is achieved. In this way an easy cleaning of the invention from the residues of the projectile is achieved, while the invention is used, thus eliminating the requirement for its cleaning. Because of the property of self-cleaning, the present invention eliminates the cleaning costs, including staff salaries and consumables.

The use of the compact hybrid elastomeric enables the implementation of many molding techniques, while ensuring maximum performance, since the molded elastomeric compounds may reach the hardness levels of hard plastic and simultaneously maintain their elastic characteristics. It shows a high percentage of self-healing in the direction of the tension and protects old and new surfaces with a single vapor permeable elastic membrane of high strength to moisture, high temperatures and UV rays. Its hybrid technology makes it ideal for demanding applications with long lasting results.

Given that the desired results are achieved in a simple structure which does not use consumables, the present invention is also economical in operation. Since the materials used for the construction of the present invention are susceptible to any kind of treatment in an easy way, an ecological shooting training panel for any type and caliber ammunition may be formed in all shapes and sizes depending on its application.

An ecological shooting training panel for any type and caliber ammunition, according to the present invention, deactivates safely the projectiles and captures them without lead powder and fragments. These features allow shooters to go to the shooting range and target at very close distances, even under great angle without risking ricochet of the projectile, and escape of dangerous dust.

The existence of a fragments hopper in the bottom part of the single surface of the layers, according to the present invention, simplifies even more the function of an ecologic shooting training panel for any type and caliber ammunition because the accumulation of the fragments within the hopper is achieved as well as their direction for example into a collection container for their easy removal. Thus the dispersion of fragments and dust is avoided and the risk of contact with users is reduced, since they circulate in the shooting area and step on these hazardous materials and therefore transfer fragments everywhere even out of the shooting area.

An advantage of an ecological shooting training panel for any type and caliber ammunition, according to the present invention, is that it can be formed in a continuous shooting surface, which will have the ability to take different shapes and dimensions and bear an imprinted targets rotation system. Therefore, it has a large field of applications, e.g. it is suitable for use as an educational trap type targeting framework in open and closed shooting ranges, as surface coating material in shooting areas—such as walls, ceilings, floors—and as a material for creating shooting areas for civil use. Furthermore, the simple construction and assembly allow direct replacement of any part, making it a functional and economical equipment kit.

BRIEF DESCRIPTION OF THE DRAWINGS

The construction and use of the present invention will be more clearly understood from the following description and with the aid of the attached drawings, namely:

In FIG. 5 the technical assembly of the repeated metallic mesh of rhomboid form (5) is shown in detail.

DETAILED DESCRIPTION

The ecological shooting training panel of any type and caliber of the present invention is of rectangular section and operates as material for the creation of training facilities, i.e., external and internal walls, where all the mentioned features of the present invention are required. It can be manufactured in various dimensions (length, width and height). Indicatively, it can be manufactured in dimensions (L×W×H5) =0.8×08×1.2 meters, without of course including the support bases (1) and various forms of transport and handling equipment (33) and the imprinted goals rotation system (8)

Figure 1:
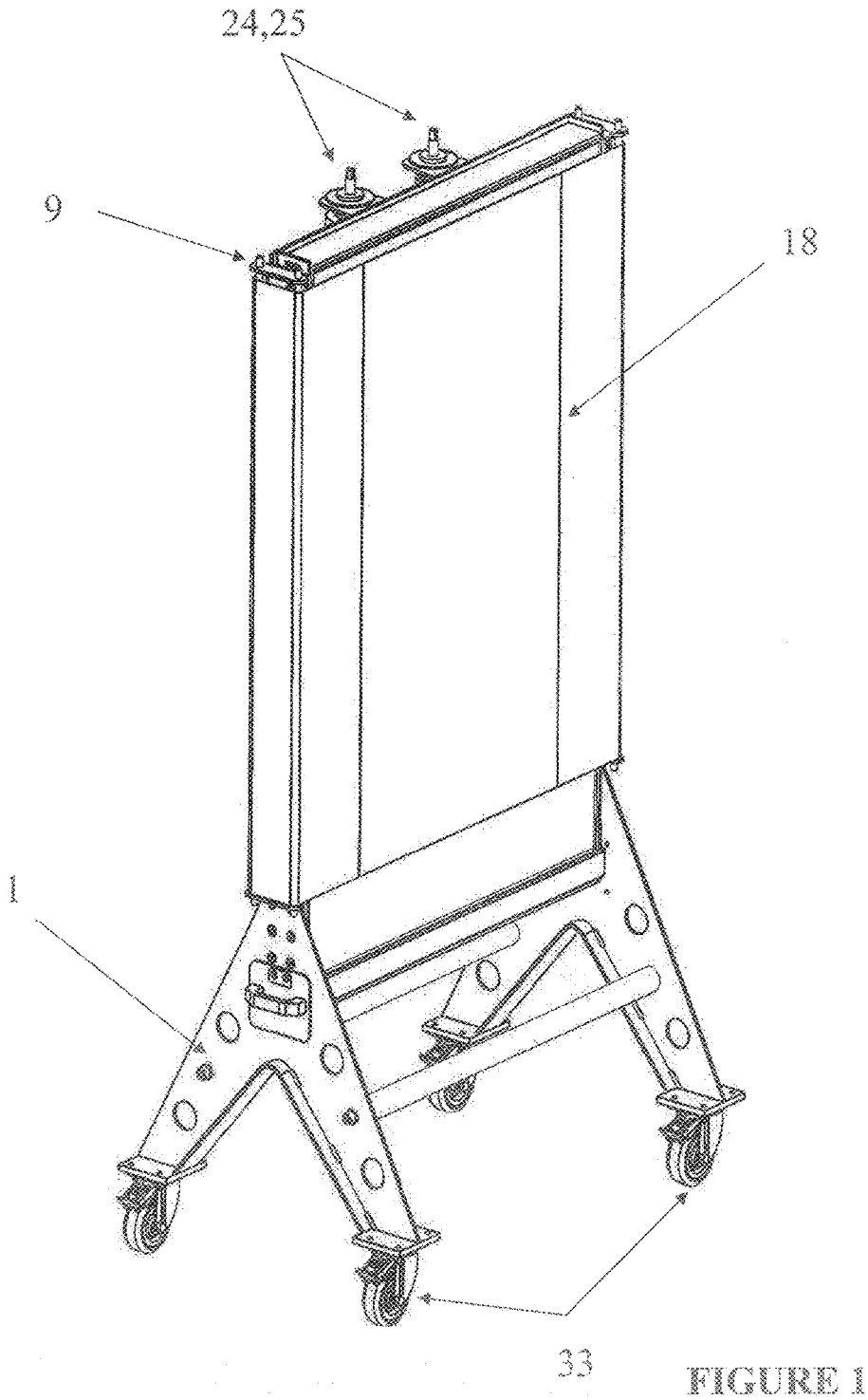
FIG. 1 illustrates a perspective view of the ecological shooting training panel for any type and caliber ammunition, where the special paper surface (18) of the imprinted targets rotation system (8), the support bases (1) and various forms of transport and handling equipment (33) can be seen.
Figure 2:
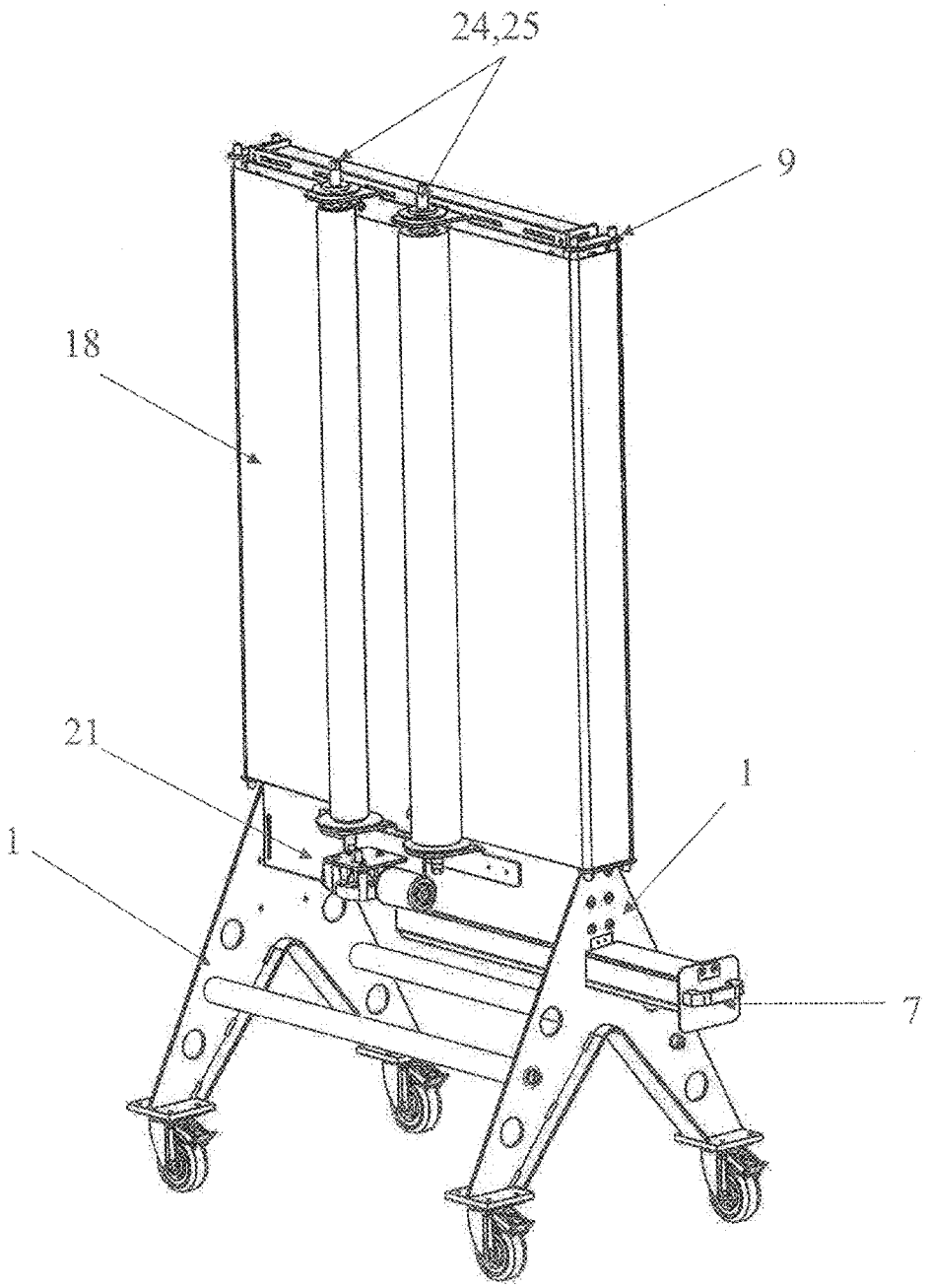
FIG. 2 illustrates a perspective view of the rear surface of the ecological shooting training panel for any type and caliber ammunition where the special paper surface (18) of the imprinted targets rotation system (8) and its details can be seen as well as the support bases (1) and various forms of transport and handling equipment (33) and the fragments outlet and concentration hopper (7) of high hardness metal.

In FIGS. 1,2 is presented a perspective front and rear view of an ecological shooting training panel for any type and caliber ammunition, where the present invention is exemplified in these figures in flat form and may optionally be fixed on support bases (1) and various forms of transport and handling equipment (33) when used as an educational trap type targeting framework, as well as creating material shooting sites in the form of external and internal walls, and also can be mounted on surfaces as side walls, ceiling, floor in the form of one-sided coating with the compact metal sheet (2) being in touch with these surfaces.

Figure 3:
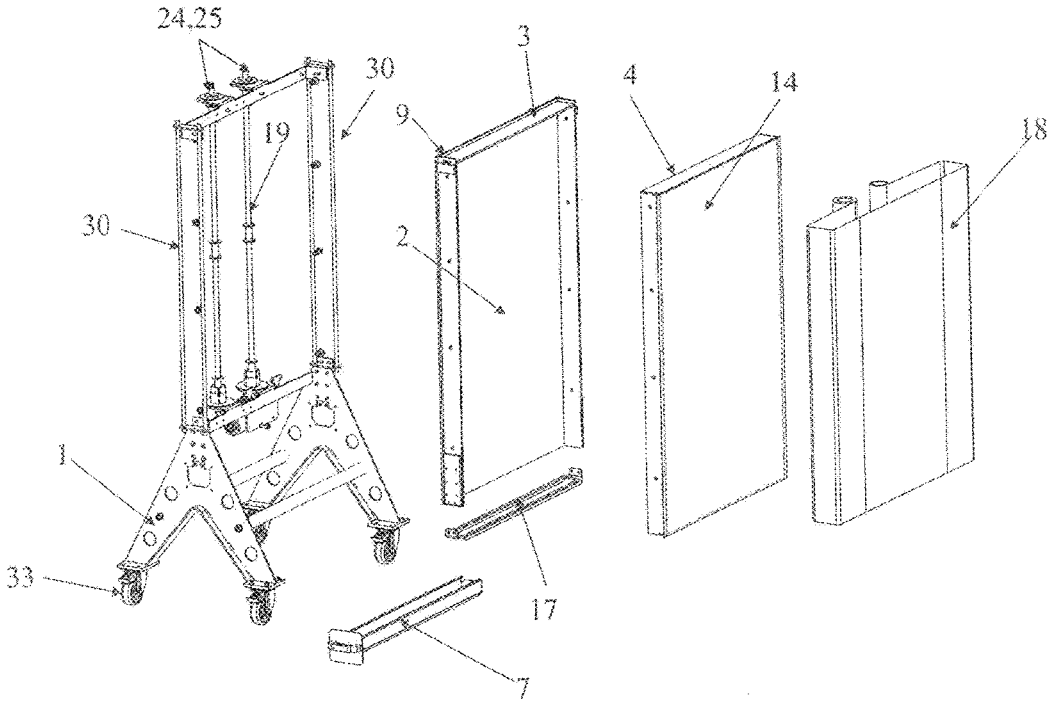
FIG. 3 illustrates the full formulation of the parts at the front side of the ecological shooting training panel for any type and caliber ammunition, where details of the rotation system with imprinted targets (8) can be seen, as well as the metallic solid sheet (2) of rectangular cross section from high hardness steel bearing a metal support frame (3) of rectangular cross section and high hardness with the appropriate attachment points (9), the metal support frame (4) of rectangular cross section from high hardness steel, the elastomeric layer (14) and fragments outlet and concentration hopper (7) of high hardness metal.
Figure 4:
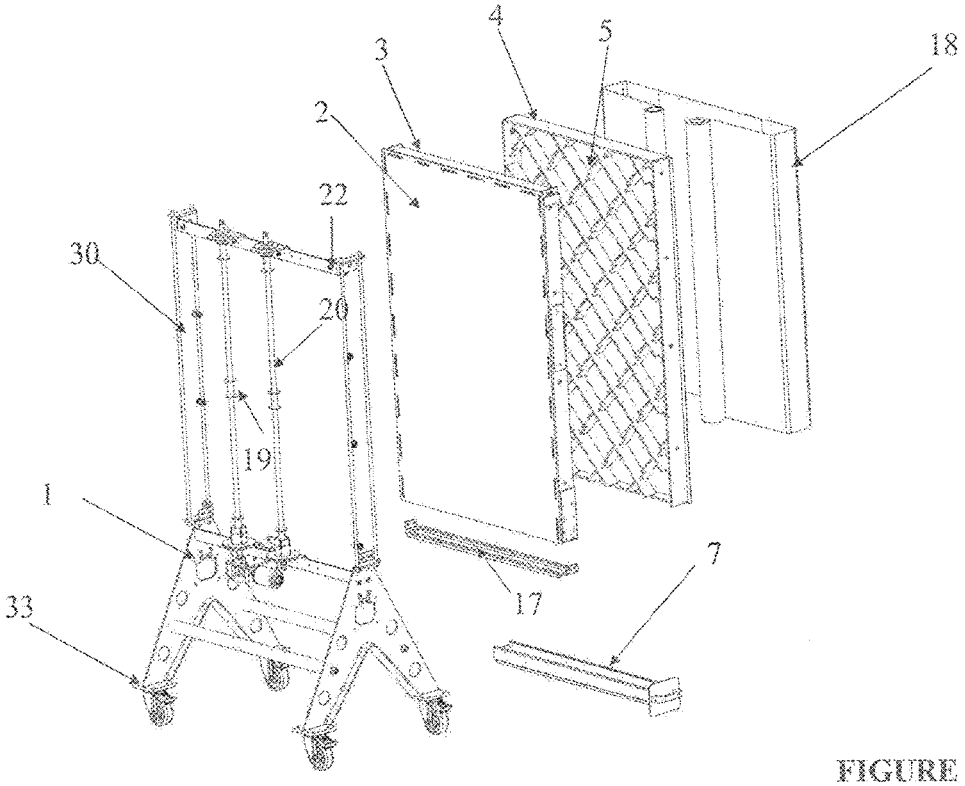
FIG. 4 illustrates the complete exploded view of the parts of the back side of the ecological shooting training panel for any type and caliber ammunition, where details of the imprinted targets rotation system (8) can be seen, and in particular the compact metal sheet (2) of rectangular cross section and of high hardness steel, the repeated metal mesh with rhomboid shape (5) and also the fragments outlet and concentration hopper (7) of high hardness metal.

As presented in FIGS. 3 and 4, an ecological shooting training panel for any type and caliber ammunition, according to the present invention, comprises: a metallic compact sheet (2) of rectangular cross section from high hardness steel bearing a metal support frame (3) of rectangular cross-section and high hardness which is fixedly screwed around the metal compact sheet (2), apart from the bottom side, and also has suitable suspension points (9); a metal support frame (4) of rectangular cross section from high hardness steel having a layer of numerous metal plates of high hardness in a specific arrangement to each other to create repeated metal mesh with rhomboid shape (5); a hybrid elastomer (6), a spreadable material of a one component based polyurethane and synthetic acrylic resins, which is injected into the metal frame (4) and forms an elastomer layer (14); a fragments outlet and concentration hopper (7) of high hardness metal; and optionally support bases (1) and various forms of transport and handling equipment (33) and also an imprinted goals rotation system (8).

Specifically, in the present invention a compact metal sheet (2) of rectangular cross section is made from high hardness steel of at least 10 mm thickness. In its perimeter is affixed a metal support frame (3), apart from its bottom side, which is equipped with suitable suspension points (9) when mounted on surfaces as side walls, ceiling, floor, etc., and in which is placed a metal support frame (4) of rectangular cross section from high hardness steel, of equal size and at least 6 mm thickness, and to which is welded a layer of numerous metal plates of high strength steel in a specific arrangement to each other in which is injected a selected hybrid elastomer (6), a spreadable material of one component, based on polyurethane and synthetic acrylic resins.

Figure 5:
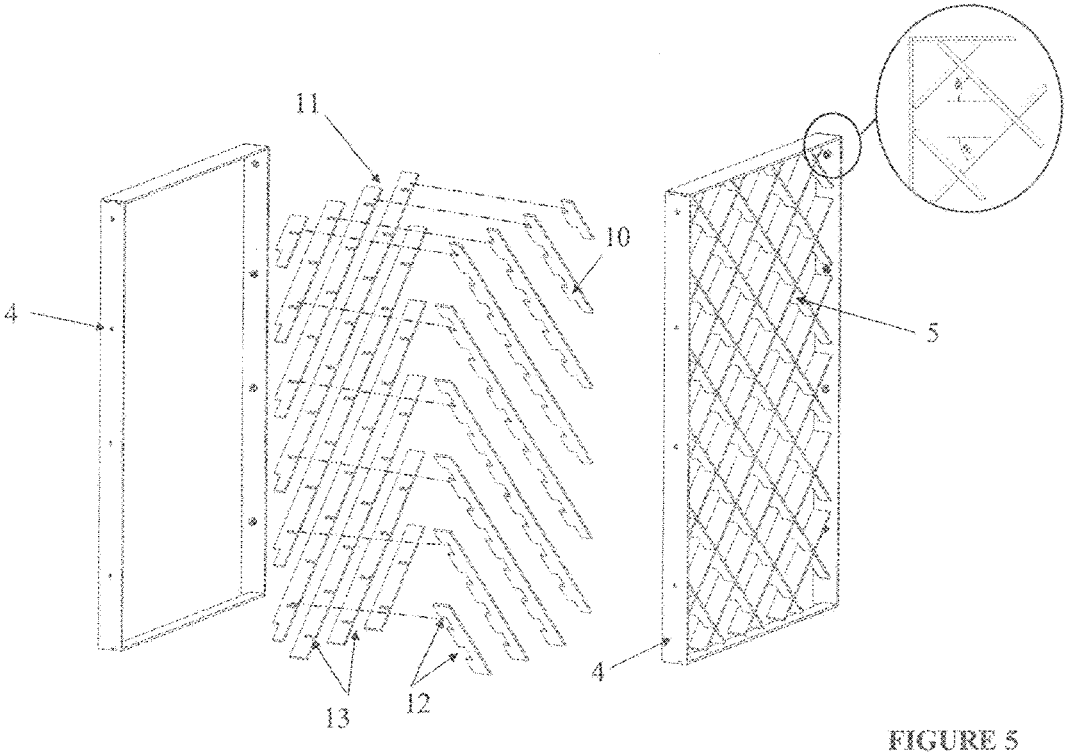
FIG. 5 illustrates the metal support frame (4) of rectangular cross section from high hardness steel, and the metal plates type A and B (10,11) and their respective indents (12,13).

In FIG. 5 is presented the preferable arrangement way of metal plates which form the repeated mesh with rhomboid shape (5), without excluding any other configuration. Specifically, the metal plates of special design are of two types A (10) and B (11) with a different repeating pattern. They are of the same thickness but different length and width and the same number is used by each type.

Type A (10), with at least 10 mm thickness, is bearing along its length equal-sized indents (12) with at least 50 mm distance between each other, while type B (11), of 10 mm thickness, also bears along its length equal-sized indents (13) of greater length, indicatively with a distance of at least 100 mm to each other.

The metal plates type A and B (10, 11) are of rectangular shape with enhanced surface hardness and strength, and are welded to the metal support frame (4) so that their thickness generates practically the metal mesh with rhomboid shape (5). As presented in FIG. 5, the assembly technique is that first the plate type B (11) is placed with an inclination of 45° degrees to the vertical side of the metal support frame (4), with its indents (13) forming the outer surface of the parallel arranged plates, The distance between plates type B is identical. Subsequently the plates type A (10) are placed by the same way with an inclination of 45° degrees, having equal distance from each other, but on the other vertical side of the metal support frame (4) with its indents (12) to form the inner surface of the parallel arranged plates.

The result of plates placement in this way is the vertical joint of the formed respective parallel arranged plates, since their respective indents (12, 13) are in direct contact in a way to generate a repeated mesh with rhomboid shape (5), with the surfaces of welded plates type A and B (10,11) forming the front side of the metal support frame (4).

It should be noted that the placement of the plates on the metal support frame (4) takes place in a way as to cover its largest possible surface. Specifically, the width of metal plates type A and B (10, 11) is appropriately designed so that the height of the formed metal mesh with rhomboid shape (5) covers a specific height area in order to meet the design objectives of the present invention.

Figure 6:
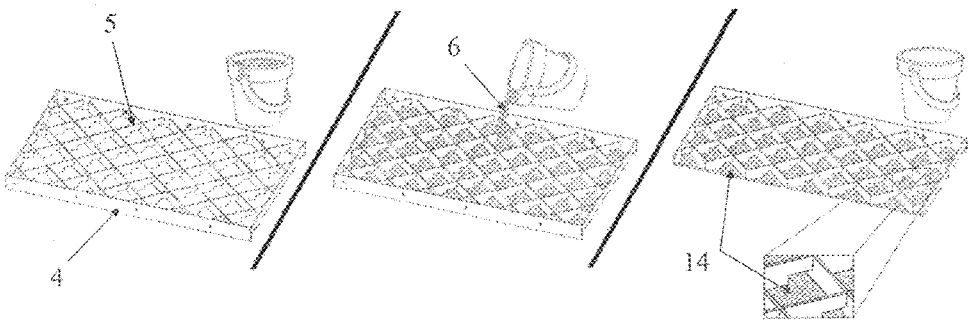
FIG. 6 illustrates the injection technique of the hybrid elastomeric (6), a spreadable material of one component based on polyurethane and synthetic acrylic resins, in the repeated metallic mesh of rhomboid form (5), thus creating a compact layer of elastomeric material (14).

Over the metal mesh with rhomboid shape (5) of the metal plates type A and B (10, 11), as presented in FIG. 6, is injected a selected hybrid elastomer (6), a spreadable material of one component based on polyurethane and synthetic acrylic resins, which creates a compact elastomeric material layer (14) of suitable thickness so as to cover the required height of the metal mesh with rhomboid shape (5). The injection technique lies in that the metal support frame (4) is placed with its front surface looking down, so to not generate concaves/curvatures, and then the appropriate amount of the hybrid elastomer (6) is injected, which is then cooled and formed directly into the elastomeric compact layer (14).

The elastomeric layer (14) constitutes the impact side of projectiles and is a material of high percent of elongation at break, of high strength diffusion, cutting, pressure and friction, of low permanent deformation, suitable for resistance to penetration by projectiles without its destruction, and capable of absorbing impact energy thereof and retaining fragments of the projectiles within mentioned layer.

The selection of the hybrid elastomer (6) lies in that it has a high percentage of self-healing since it is an amorphous elastomeric consisting of molecular chains which are highly twisted, eccentric and coiled, and on the application of the tension of a tensile load, in particular the throwing missile, takes place the partial uncoiling, untwisting, the arrangement and the final resulting elongation of the chains towards tension. The chains of selected elastomer are capable, upon termination of the tension, to immediately bounce back to earlier formulations resulting in the macroscopic piece of material to return to its original shape. Also the fact that the hybrid elastomer (6) is molded ensures the protection of old and new surfaces with a single vapor permeable elastic membrane of high strength to moisture, high temperatures and UV rays.

Figure 7:
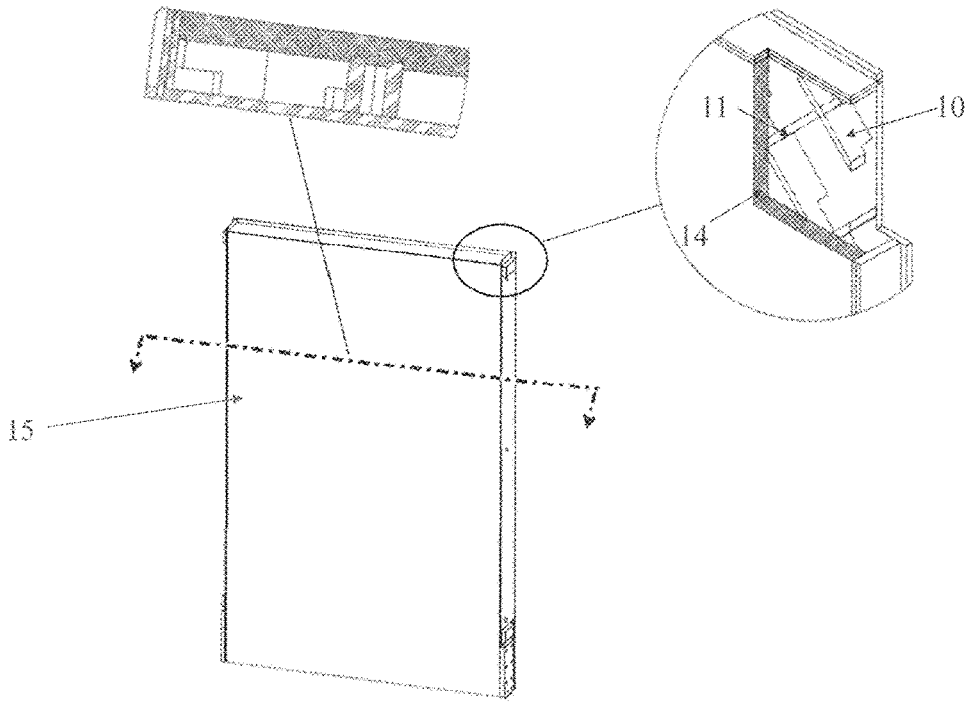
FIG. 7 illustrates a perspective view of the single surface (15) of the ecological shooting training panel for any type and caliber ammunition, emphasizing the top view and the isometric sectional view of the plates type A and B (10,11) arrangement.

Then, since the elastomeric layer (14) has been created on the metal mesh with rhomboid shape (5) of metal plates type A and B, the metal support frame (4) is placed inside the metal compact layer (2) and is fixed to the metal frame support (3). In FIG. 7 is presented the final configuration of the single surface (15) forming the ecological shooting training panel for any type and caliber ammunition, as results after its construction, with emphasis on the layout of metal plates type A and B (10,11).

Figure 8:
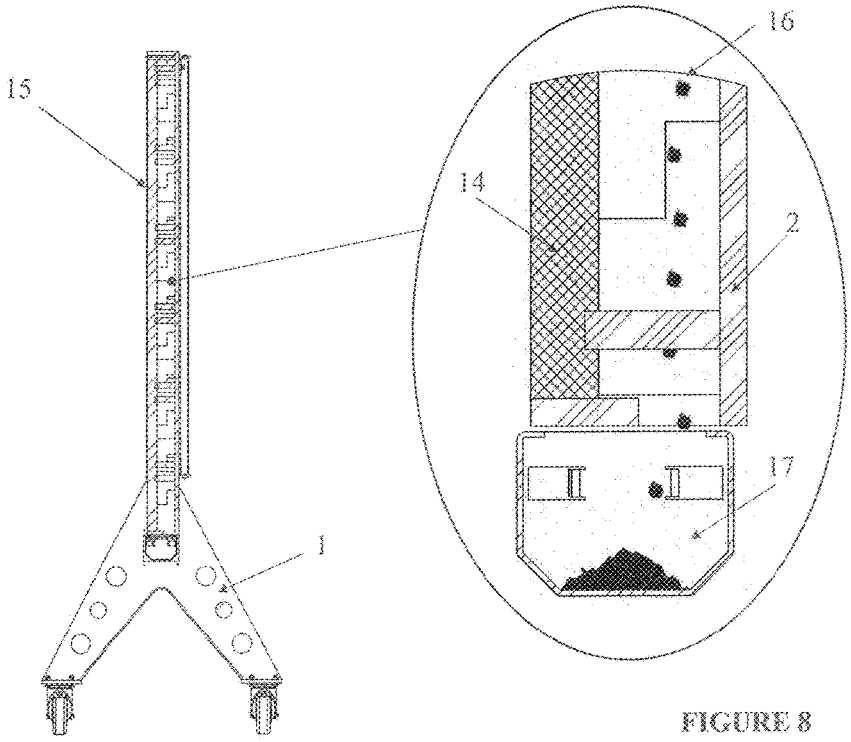
FIG. 8 illustrates a side cross section of the single surface (15) of the ecological shooting training panel for any type and caliber ammunition, with emphasis on the residues flow (16) of the projectiles by gravity to fragments outlet and concentration hopper (7) of high hardness metal.

The configuration of the single surface (15) forming the ecological shooting training panel for any type and caliber ammunition results to the formation of a gap, as presented in FIG. 8, in which takes place the projectiles residues flow (16) (fragments-powders) by gravity to the bottom of the metal support frame (3) of the metal compact layer (2), in order to allow the output of these residues (16) from the interior of the single surface (15) and thus taking place the simultaneous cleaning from those.

At the bottom of the single surface (15), as presented in FIGS. 2 and 8, wherein there is no metal support frame (3), a fragments outlet hopper (7) is adjusted (7) in a suitable support base (17). The placement of the fragments outlet hopper (7) to the support base (17) offers the ability of easy movement and thereby cleaning of the outlet hopper (7), which may have various sizes and shapes from that illustrated. Also, a special handle (32) easy movement of hopper 7 is shown in FIGS. 3 and 4. Optionally, the outer surface of ecological shooting training panel for any type and caliber ammunition of the present invention is surrounded by the imprinted goals rotation system (8).

Specifically, it concerns an ergonomically designed imprinted goals rotation system, which are printed in a special paper surface (18). The operating principle of this system is the fact that after the use of ecological shooting training panel for any type and caliber ammunition, the user can via a wired/wireless handling and specifically by pressing a button (19) make it again ready for use, since the change of the special paper surface (18) takes place automatically.

Figure 9:
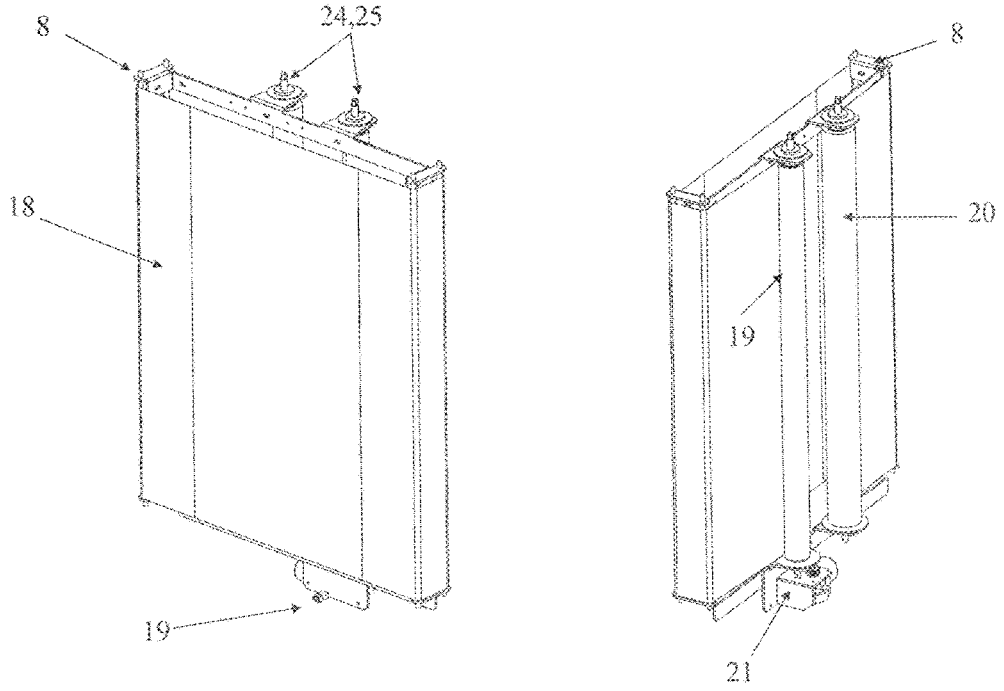
FIG. 9 illustrates a perspective front and back view of the imprinted targets rotation system (8).
Figure 10:
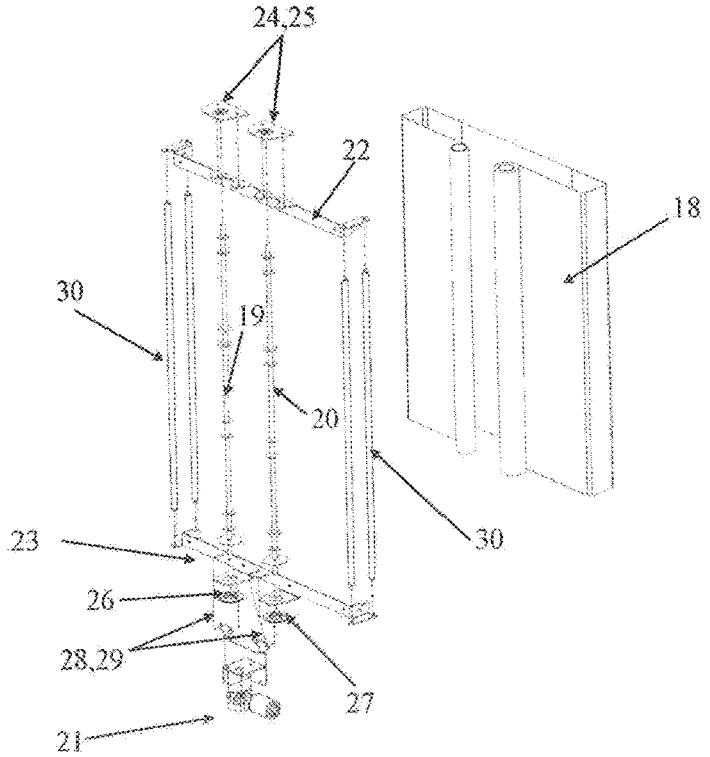
FIG. 10 illustrates the complete exploded view of parts of the imprinted targets rotation system (8) with the individual construction details.

As presented in FIGS. 9, 10, the imprinted goals rotation system (8) comprises at its rear side two vertical metal shafts (19, 20) which perform rotary motion, while at its front side, there is the special paper surface (18) with the shaded view.

The operating mode is described in the following steps:

a) The vertical metal shaft (19) is rotated by means of a drive electromotor (21), so that the specific paper surface (18) can be wrapped around it, while b) the second vertical shaft (20), performing a free movement, is rotating in the opposite direction, in order for the special paper surface (18) to be unwounded therefrom.

Through the above mentioned process, the vertical metal shaft (19) collects the already "beaten" targets around it, contrary to the vertical metal shaft (20) which is unwounded to make happen the circular motion display of the special paper surface (18) with the net-non "beaten" targets.

In order to support the vertical metal shafts (19, 20), two metal bases (22, 23) are used which are mounted respectively on the top and bottom of the compact metal sheet (2). In addition, to each end of the metal bases (22, 23) are placed two cylindrical metal shafts (30) to assist moving of the entire special paper surface (18).

Two metal plates (24, 25) of equal size to each other are connected to the upper metal base (22) to prevent movement of the vertical metal shafts (19, 20) while allowing rotation.

Correspondingly, two other metal plates (26, 27)) of equal size, connected to the lower metal base (23) via two bearings (28, 29), prevent movement of the vertical metal shafts (19, 20), and simultaneously allow their rotation.

Figure 11:
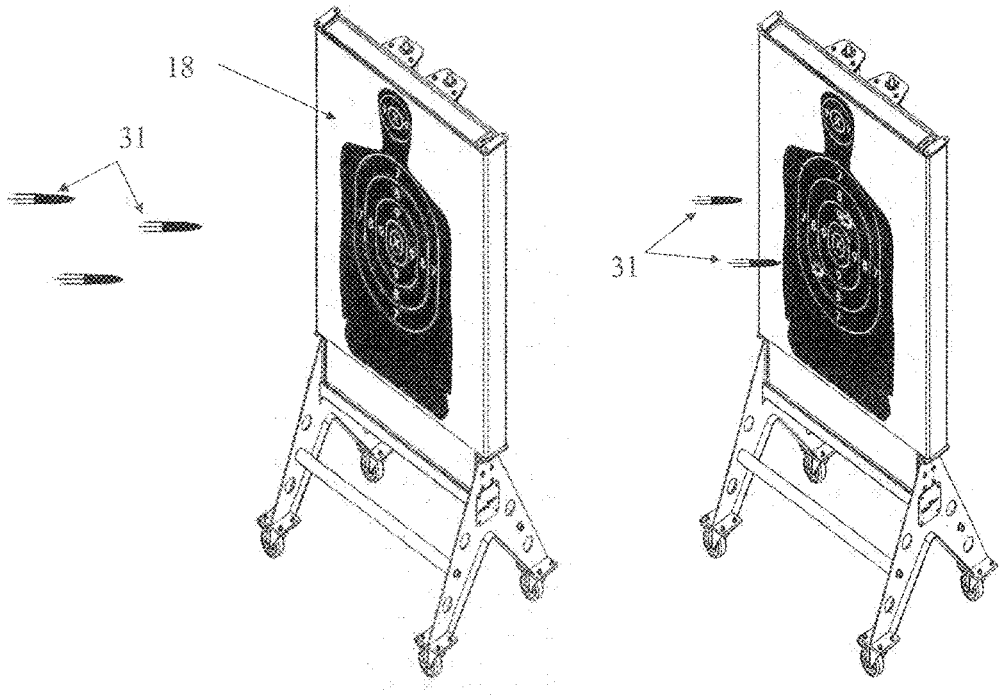
FIG. 11 illustrates an application of the ecological shooting training panel for any type and caliber ammunition, illustrated in flat shape, which is shot by projectiles (31).

In FIG. 11 is presented the capability of an ecological shooting training panel for any type and caliber ammunition, according to the present invention, to be shot by projectiles (31) from different angles and distances.

The ecological shooting training panel for any type and caliber ammunition according to the invention has the capability to absorb incoming projectiles (31) within the single surface (15), to destroy them completely by pulverizing their metallic mass and to retain fragments and hazardous dust (16) thereof within, so as to prevent their ricochet and output (16, 31) and render it safe to use by any trainee.

Figure 12:
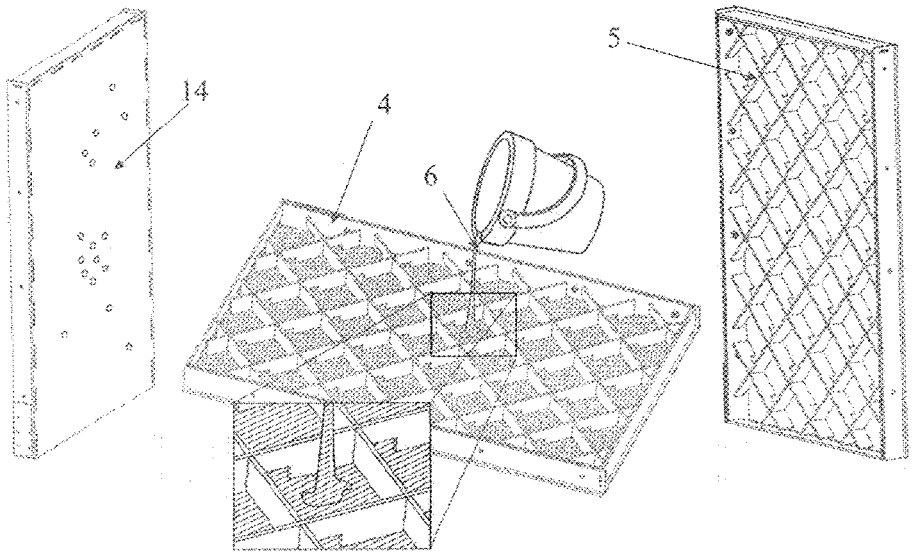
FIG. 12 illustrates the application of a direct replacement and repair of a compact elastomeric material layer (14), by injecting the hybrid elastomeric (6), a spreadable material of one component based on polyurethane and synthetic acrylic resins, in the repeated metallic mesh of rhomboid form (5).

Finally, in FIG. 12, is presented the capability of direct replacement of any part, making it a functional and economical equipment kit. FIG. 12 illustrates the application of a direct replacement and repair of compact elastomeric material layer (14), by injecting the hybrid elastomer (6), a spreadable component of one material based on polyurethane and synthetic acrylic resins, in the repeated metal mesh with rhomboid shape (5).

What is claimed is:

1. An ecological shooting training panel, comprising:

a compact metal sheet formed of high hardness steel;

a first metal support frame having a high hardness fixedly mounted to and extending around and along the compact metal sheet, wherein the first metal support frame has a bottom opening that extends along a bottom side of the compact metal sheet;

a frame assembly mounted to the first metal support frame, the frame assembly having a second metal support frame formed of high strength steel, a plurality of metal plates having a high hardness fixedly mounted to the second metal support frame to form a rhomboid-shaped metal mesh, and a compact layer of elastomeric material covering the rhomboid-shaped metal mesh, the compact metal sheet being spaced from the compact layer of elastomeric material to provide an open gap formed by the compact metal sheet, rhomboid-shaped metal mesh and compact layer of elastomeric material, the open gap opening into the bottom opening of the first metal support frame;

at least one target configured to be removably mounted over the frame assembly;

a support base removably supporting the compact metal sheet, first metal support frame, frame assembly, and target; and a metal container removably mounted to the support base and under the bottom opening of the first metal support frame.

2. The ecological shooting training panel according to claim 1; wherein the metal plates comprise first and second metal plates of different lengths and widths each having a thickness of at least 10 mm, each of the first metal plates having equal-sized indents and spaced along the length thereof at a distance of at least 50 mm to each other, and each of the second metal plates having equal-sized indents and spaced along the length thereof at a distance of at least 100 mm to each other.

3. The ecological shooting training panel according to claim 1; wherein the metal plates are welded to the second metal support frame so that thicknesses of the plurality of metal plates form a front surface of the second metal support frame and widths of the plurality of metal plates define the height of the rhomboid-shaped metal mesh in the second metal support frame.

4. The ecological shooting training panel according to claim 2; wherein the metal plates comprise first and second metal plates, each of the first metal plates having equal-sized indents spaced along the length thereof at a first distance to each other, and each of the second metal plates having equal-sized indents spaced along the length thereof at a second distance to each other greater than the first distance; wherein the second metal plates are arranged in parallel at an equal distance to one another with an inclination of 45° degrees relative to one vertical side of the second metal support frame, surfaces of the second metal plates in which the indents are formed providing an outer surface of the parallelly arranged second metal plates; wherein the first metal plates are arranged in parallel at an equal distance to one another with an inclination of 45° degrees relative to another vertical side of the second metal support frame so that the indents of the first metal plates directly engage the respective indents of the second metal plates, surfaces of the first metal plates in which the indents are formed providing an inner surface of the parallelly arranged first metal plates.

5. The ecological shooting training panel according to claim 4; wherein the compact layer of elastomeric material is disposed on the outer surface of the parallelly arranged second metal plates and constitutes an impact side for fired projectiles and on which the target is removably provided.

6. The ecological shooting training panel according to claim 5; wherein the compact layer of elastomeric material comprises a self-healing elastomer of polyurethane and synthetic acrylic resins in the form of a single vapor permeable elastic membrane resistant to moisture, high temperatures and UV rays.

7. The ecological shooting training panel according to claim 5; wherein the first metal support frame to which the compact metal sheet is fixedly mounted and the frame assembly securely mounted to the first metal support frame form a single integral structure with an interior having the open gap and configured to absorb impact energy of a projectile fired at the target.

8. The ecological shooting training panel according to claim 7; wherein the single integral structure is configured so that projectile fragments and dust reach the interior of the single integral structure and are removed from the interior by dropping into the metal container through the open gap.

9. The ecological shooting training panel according to claim 1; wherein the at least one target comprises a plurality of targets, the compact layer of elastomeric material forming an impact side for fired projectiles and on which each of the targets is configured to be removably positioned; and further comprising a target rotation system for rotationally positioning each of the targets on the impact side, the target rotation system comprising a first rotary metal shaft configured to support a roll of paper containing the targets and from which the roll of paper can be unwound, a second rotary metal shaft on which targets from the roll of paper are wound during rotational positioning by the target rotation system, and a motor for rotationally driving the second rotary metal shaft to wind thereon the targets during rotational positioning thereof while the roll of paper is unwound from the first rotary metal shaft.

10. The ecological shooting training panel according to claim 9; wherein the target rotation system further comprises two metal bases mounted respectively on the top and bottom of the compact metal sheet for supporting the first and second rotary metal shafts, and two cylindrical metal shafts mounted to ends of the two metal bases to assist in the rotational positioning of the targets during rotation of the first and second rotary metal shafts.

11. The ecological shooting training panel according to claim 10; wherein the target rotation system further comprises first metal plates connected to the metal base on the top of the compact metal sheet, and second metal plates connected to the metal base on the bottom of the compact metal sheet with respective bearings interposed therebetween, the first and second metal plates and bearings preventing movement of the first and second rotary metal shafts along respective length directions thereof while permitting rotational movement thereof.

12. The ecological shooting training panel according to claim 1; wherein the compact elastomeric material is configured for direct replacement and repair.

13. The ecological shooting training panel according to claim 1; wherein each of the compact metal sheet, first metal support frame and second metal support frame has a rectangular cross-section; and wherein the compact layer of elastomeric material is made of polyurethane and synthetic acrylic resin materials.

14. The ecological shooting training panel according to claim 1; wherein the first metal support frame to which the compact metal sheet and frame assembly are mounted includes suspension points for mounting the first metal support frame to a surface of anyone of a sidewall, ceiling and wall.

15. An ecological shooting training panel, comprising:

compact metal sheet mounted in and retained by a first metal support frame;

a rhomboid-shaped metal mesh disposed on opposite and spaced from the compact metal sheet, the rhomboid-shaped metal mesh being mounted in and retained by a second metal support frame connected to the first metal support frame;

a compact layer of elastomeric material disposed directly on and covering the rhomboid-shaped metal mesh, the compact layer of elastomeric material being spaced from the compact metal sheet to provide an open gap formed by the compact metal sheet, rhomboid-shaped metal mesh and compact layer of elastomeric material; and a target configured to be removably mounted directly over the compact layer of elastomeric material such that when a projectile is fired at the target, the projectile passes through the target, the combined structural arrangement of the compact metal sheet, rhomboid-shaped metal mesh and compact layer of elastomeric material absorbs an impact energy of the projectile, and residue generated by the projectile drops through the open gap.

16. The ecological shooting training panel according to claim 15; further comprising a collection container for collecting the residue that drops through the open gap.

17. The ecological shooting training panel according to claim 16; further comprising a support base for removably supporting the combined structural arrangement; wherein the first metal support frame is mounted around the compact metal sheet except around one side of the compact metal sheet; and wherein the collection container is mounted on the support base at the one side of the compact metal sheet.

18. The ecological shooting training panel according to claim 15; wherein the rhomboid-shaped metal mesh comprises a plurality of metal plates of high hardness fixedly mounted to the second metal support frame.

19. The ecological shooting training panel according to claim 18; wherein the metal plates comprise first metal plates having equal-sized indents spaced along the length thereof at a first distance to each other, and second metal plates having equal-sized indents spaced along the length thereof at a second distance to each other greater than the first distance.

20. The ecological shooting training panel according to claim 15; wherein the compact layer of elastomeric material is resistant to penetration by the projectile such that the projectile is subjected to destruction when fired at the target, the compact layer of elastomeric material being configured to retain fragments of the projectile resulting from its destruction.

* * * * *